US007112260B2

(12) United States Patent
Straub et al.

(10) Patent No.: US 7,112,260 B2
(45) Date of Patent: Sep. 26, 2006

(54) PROCESS AND DEVICE FOR CLEANING A CIRCULATING BELT

(75) Inventors: Karlheinz Straub, Heidenheim (DE); Michael Sollinger, Stuttgart (DE)

(73) Assignee: Voith Paper Patent GmbH, Heidenheim (DE)

( * ) Notice: Subject to any disclaimer, the term of this patent is extended or adjusted under 35 U.S.C. 154(b) by 328 days.

(21) Appl. No.: 10/188,094

(22) Filed: Jul. 3, 2002

(65) Prior Publication Data

US 2003/0019602 A1 Jan. 30, 2003

(30) Foreign Application Priority Data

Jul. 26, 2001 (DE) ..... 101 36 467

(51) Int. Cl.
*D21F 1/32* (2006.01)

(52) U.S. Cl. ..... 162/199; 162/272; 162/273; 162/274; 162/275; 134/9; 134/15; 134/24; 134/34; 134/122 R; 134/144; 134/172; 239/124; 239/135

(58) Field of Classification Search ..... 162/199, 162/272–275; 134/9, 15, 24, 34, 122 R, 134/144, 172; 239/124, 135
See application file for complete search history.

(56) References Cited

U.S. PATENT DOCUMENTS

| | | | | |
|---|---|---|---|---|
| 3,279,976 | A * | 10/1966 | Eagle et al. | 162/275 |
| 4,672,985 | A * | 6/1987 | Mohr | 134/57 R |
| 5,964,956 | A | 10/1999 | Straub et al. | |
| 6,136,148 | A | 10/2000 | Koskinen et al. | |
| 6,143,092 | A | 11/2000 | Straub et al. | |

FOREIGN PATENT DOCUMENTS

| | | |
|---|---|---|
| DE | 19507938 | 9/1996 |
| WO | 96/23101 | 8/1996 |

* cited by examiner

*Primary Examiner*—Mark Halpern
(74) *Attorney, Agent, or Firm*—Greenblum & Bernstein, P.L.C.

(57) ABSTRACT

Device and process for cleaning a circulating belt, the device using a cleaning device having at least one nozzle. The process includes feeding a pressurized fluid to the at least one nozzle, and subjecting the circulating belt to the pressurized fluid via the at least one nozzle. The pressurized fluid has a temperature in a range of between approximately 90° C. and approximately 160° C.

10 Claims, 2 Drawing Sheets

PROCESS AND DEVICE FOR CLEANING A CIRCULATING BELT

CROSS-REFERENCE TO RELATED APPLICATIONS

The present application claims priority under 35 U.S.C. §119 of German Patent Application No. 101 36 467.9, filed on Jul. 26, 2001, the disclosure of which is expressly incorporated by reference herein in its entirety.

BACKGROUND OF THE INVENTION

1. Field of the Invention

The invention relates to a process and a device for cleaning a circulating belt, in particular a wire or felt belt, of a paper machine.

2. Discussion of Background Information

A process and a device of this type are described, e.g., in DE-C-195 07 938.

However, in such customary high-pressure cleaners of this type, the water temperature is lower than 90° C. and the pressure is approximately between 100 and 500 bar.

SUMMARY OF THE INVENTION

The invention provides a process and a device of the type mentioned at the outset but which provides for a further increase in the cleaning capacity.

According to one embodiment, the invention provides for a process for cleaning a circulating belt, in particular a wire or felt belt, of a paper machine utilizing at least one fluid jet produced by a respective nozzle, wherein the nozzle is acted on by pressurized water featuring a temperature in the range of between approximately 90° C. to approximately 160° C. The temperature may also be in the range of between approximately 100° C. and approximately 140° C. The cleaning device may also have the ability to traverse the width of the belt.

The invention thus provides for a way in which dirt can be more readily detached from the belt to be cleaned by producing a temperature shock. As a result, the relevant wire or felt meshes can be rinsed more thoroughly and more easily, i.e., because of the lower viscosity of the hot water. Moreover, the hot water can be adapted to the process temperature in an optimum way, especially when the cleaning occurs in the drying section. A higher cleaning capacity is obtained with the same water consumption, than that of the prior art methods and devices. Additionally, the invention reduces to a minimum the risk that potential production problems will occur.

The cleaning device can be further improved by using more water. Although this results in more water penetrating the belt to be cleaned and remaining there, a relatively large amount of this water also evaporates because of the relatively high temperatures, so that there is no increased reverse wetting on contact with the paper web. The temperature of the water used can also reach up to approximately 200° C. in order to increase the cleaning intensity. This would, however, depend on whether the material of the belt to be cleaned permits such high temperatures.

The amount of water remaining in the belt after it is cleaned by the device depends on the type of belt and the evaporation or vaporization distance. This amount can be in the range of between approximately 10% to approximately 20%. While approximately 40–60% of the water applied may spray back from the belt during cleaning, such can preferably be captured by a suction device. Thus, approximately 30%–40% of the water can be allowed to penetrate the belt.

In the interest of ensuring that the reverse wetting is kept as low as possible, it is essential that the amount of water applied to the belt during cleaning and the temperature of the water, are selected such that at least approximately 50%, and preferably more than approximately 60%, or in particular at least approximately 70%, of the water in the belt after cleaning evaporates between the cleaning and contact by the belt with the web. The web may be a paper, cardboard, tissue or other fibrous material web.

The nozzle is preferably acted on by highly pressurized water, and the pressure can particularly be in a range of approximately 100 bar to approximately 500 bar.

In a preferred practical embodiment of the process according to the invention, the high pressure is produced by way of a high-pressure water pump, whereby the water is heated on the high-pressure side to a temperature in the range of approximately 90° C. to approximately 160° C., and in particular between approximately 100° C. to approximately 140° C.

The high-pressure pump can thus be operated at a relatively low temperature so that wear on the pump is also kept correspondingly low. The invention may also be practiced with conventional high-pressure pumps, which as a rule are not designed for temperatures above approximately 50° C.–70° C.

The water can be heated in particular by way of a high-pressure heat exchanger. Preferably, steam removed from the steam cycle of the paper machine can be fed as a heat carrier into a container in which at least one high-pressure tube is placed. The tube may be wound to form a spiral tube, in which the highly pressurized water is correspondingly heated.

The invention also provides for the pressure in the container to be made higher than, the same as, or lower than the ambient pressure. If the pressure is, e.g., lower than the ambient pressure, the heat of condensation of the steam can thus still be used even at temperatures below approximately 100° C.

A vacuum can be created by, e.g., using a down pipe which is immersed in, e.g., a condensation tank. A lower condensation point can thus be reached in a simple way. A reduced pressure of approximately 0.5 bar is necessary for a condensation point of, e.g., approximately 80° C. and this can be achieved by, e.g., a down pipe of a height of approximately 5 m immersed in a condensation tank.

The cleaning device according to the invention accordingly includes at least one nozzle producing a respective fluid jet, wherein the nozzle can be acted upon by pressurized water featuring a temperature in the range of between approximately 90° C. to approximately 160° C., and in particular between approximately 100° C. to approximately 140° C.

The belt may be a wire or felt belt of a paper machine. At least one fluid jet may be produced by a respective nozzle, in which the nozzle is acted on by pressurized water featuring a temperature of approximately 90° C. to approximately 160° C. and in particular between approximately 100° C. to approximately 140° C. The nozzle may be acted on by highly pressurized water, whereby the pressure is preferably in a range of approximately 100 bar to approximately 500 bar. The high pressure may be produced by way of a high-pressure water pump and the water may be heated on the high-pressure side to a temperature in the range of approximately 90° C. to approximately 160° C., and in particular between approximately 100° C. to approximately 140° C. The water may be heated by way of a high-pressure heat exchanger. Steam removed from the steam cycle of the paper machine may be fed as a heat carrier into a container in which at least one high-pressure tube is placed. The tube may be spirally arranged or wound and the highly pressurized water may be correspondingly heated. The pressure in the container may be the same as or higher than the ambient pressure. The pressure in the container may be lower than the ambient pressure. The relevant reduced pressure may be produced by a down pipe immersed, in particular in a condensation tank. The amount of water applied to the belt during cleaning and the temperature of the water may be selected such that at least approximately 50%, preferably more than approximately 60%, in particular at least approximately 70% of the water in the belt after cleaning evaporates between the cleaning and contact by the belt with the web. The web may be a paper, cardboard, tissue or other fibrous material web.

The nozzle may be acted on by highly pressurized water, whereby the pressure is preferably in a range of between approximately 100 bar to approximately 500 bar. A high-pressure water pump may be provided to produce the high pressure, and a way is provided by which the water can be heated on the high-pressure side to a temperature in the range of approximately 90° C. to approximately 160° C., and in particular between approximately 100° C. to approximately 140° C. A high-pressure heat exchanger may be provided to heat the water. The high-pressure heat exchanger may include a container into which steam removed from the steam cycle of the paper machine is fed as heat carrier and in which at least one high-pressure tube is placed. The tube may be spirally wound and may be configured to allow the highly pressurized water to be correspondingly heated. The pressure in the container may be the same as or higher than the ambient pressure. The pressure in the container may be lower than the ambient pressure. The container may be made of high-grade steel. The temperature in the container may be controlled via a valve affecting the steam intake. The valve may be a temperature interlock. A steam trap may be provided at the base of the high-pressure heat exchanger. The steam trap may also preferably serve as a ventilator at the same time. The pressure in the container may be lower than the ambient pressure and a down pipe, immersed in particular in a condensation tank, may be provided to produce the relevant reduced pressure. The cleaning may take place in a drying section of a paper machine. The cleaning may take place in the press section of a paper machine. The cleaning may take place in the wire section of a paper machine.

The process according to the invention and the device according to the invention can be used advantageously, e.g., in the drying section of the paper machine, in which the hot water is adapted advantageously to the process temperature in an optimum way. However, a use, e.g., in the press section and/or in the wire section of the paper machine is also conceivable.

The invention also provides for a process for cleaning a circulating belt using a cleaning device having at least one nozzle, the process comprising feeding a pressurized fluid to the at least one nozzle and subjecting the circulating belt to the pressurized fluid via the at least one nozzle, wherein the pressurized fluid comprises a temperature in a range of between approximately 90° C. and approximately 160° C.

The subjecting may comprise subjecting the circulating belt to at least one fluid jet via the at least one nozzle. The pressurized fluid may comprise a temperature in a range of between approximately 100° C. and approximately 140° C. The pressurized fluid may comprise water. The circulating belt may be one of a wire and a felt belt. The circulating belt may be arranged on a paper machine. The pressurized fluid may comprise a pressure in a range of between approximately 100 bar and approximately 500 bar. The process may further comprise creating the pressurized fluid using a high-pressure water pump. The process may further comprise heating the pressurized fluid. The pressurized fluid may be heated between the high-pressure water pump and the at least one nozzle. The heating may comprise heating the pressurized fluid to a temperature in a range of between approximately 90° C. and approximately 160° C. The heating may comprise heating the pressurized fluid to a temperature in a range of between approximately 100° C. and approximately 140° C. The heating may comprise heating the pressurized fluid via a high-pressure heat exchanger. The process may further comprise heating the pressurized fluid using steam. The process may further comprise removing the steam from a steam cycle of a paper machine.

The process may further comprise feeding the steam to a container which houses at least one high-pressure tube and heating the pressurized fluid inside the at least one high-pressure tube. The at least one high-pressure tube may be one of spirally formed and spirally wound. The process may further comprise creating a pressure in the container which is approximately equal to or greater than ambient pressure. The process may further comprise creating a pressure in the container which is approximately equal to or less than ambient pressure. The process may further comprise controlling a pressure in the container using a down pipe immersed in a condensation tank. The process may further comprise maintaining a reduced pressure in the container using a down pipe immersed in a condensation tank. The process may further comprise controlling an amount of pressurized fluid which is applied to the circulating belt. The process may further comprise regulating both the amount of pressurized fluid and the temperature of the pressurized fluid such that at least approximately 50% of the pressurized fluid evaporates after the subjecting.

More than approximately 60% of the pressurized fluid may evaporate after the subjecting. At least approximately 70% of the pressurized fluid may evaporate after the subjecting. The process may further comprise cleaning the circulating belt and thereafter allowing the circulating belt to contact a web comprising one of a paper web, a cardboard web, a tissue web, and a fibrous material web.

The invention still further provides for a device for cleaning a circulating belt, comprising at least one nozzle which produces a fluid jet and a source of pressurized fluid coupled to the at least one nozzle, wherein the pressurized fluid comprises a temperature in a range of between approximately 90° C. and approximately 160° C.

The at least one nozzle may direct the fluid jet against the circulating belt. The circulating belt may comprise one of a wire and a felt belt. The device may be arranged on a paper machine. The pressurized fluid may comprise water. The pressurized fluid may comprise a temperature in a range of between approximately 100° C. and approximately 140° C. The pressurized fluid may comprise a pressure in a range of between approximately 100 bar and approximately 500 bar. The source of pressurized fluid may comprise a high-pressure water pump. The source of pressurized fluid may comprise a pressurized fluid heating system. The source of pressurized fluid may comprise a pressurized fluid heating system. The pressurized fluid heating system may comprise a high-pressure heat exchanger. The high-pressure heat exchanger may comprise a container which uses steam to heat the pressurized fluid.

The device may further comprise a system that feeds steam removed from a steam cycle of a paper machine. The high-pressure heat exchanger may comprise at least one high-pressure tube arranged inside the container. The at least one high-pressure tube may be one of spirally formed and spirally wound. A pressure in the container may be approximately equal to or greater than ambient pressure. A pressure in the container may be approximately equal to or less than ambient pressure. The device may further comprise a device that controls a pressure in the container. The device that controls the pressure in the container may comprise a down pipe immersed in a condensation tank. The container may be made of one of a high-grade steel and stainless steel. The device may further comprise a system for controlling a temperature inside the container. The system for controlling a temperature inside the container may comprise a valve which regulates a steam intake. The valve may comprise a temperature interlock. The device may further comprise a steam trap coupled to the container. The steam trap may be arranged at a base of the high-pressure heat exchanger. The steam trap may function as a ventilator. The device may be arranged in a drying section of a paper machine. The device may be arranged in a press section of a paper machine. The device may be arranged in a wire section of a paper machine.

The invention still further provides for a method of cleaning a circulating belt of a paper machine using a device for cleaning the circulating belt which comprises at least one nozzle arranged near the circulating belt, a high-pressure heat exchanger, and a high-pressure pump, the method comprising feeding a pressurized fluid from the high-pressure pump to the high-pressure heat exchanger, heating the pressurized fluid in the high-pressure heat exchanger to a temperature in a range of between approximately 90° C. and approximately 160° C., feeding the heated pressurized fluid from the high-pressure heat exchanger to the at least one nozzle, and directing the heated pressurized fluid against the circulating belt via the at least one nozzle.

The invention also provides for a device for cleaning a circulating belt of a paper machine comprising at least one nozzle arranged near the circulating belt. The at least one nozzle directs a heated pressurized fluid against the circulating belt. A high-pressure heat exchanger feeds the heated pressurized fluid to the at least one nozzle. A high-pressure pump feeds a pressurized fluid to the high-pressure heat exchanger. The heated pressurized fluid has a temperature in a range of between approximately 90° C. and approximately 160° C.

Other exemplary embodiments and advantages of the present invention may be ascertained by reviewing the present disclosure and the accompanying drawing.

BRIEF DESCRIPTION OF THE DRAWINGS

The present invention is further described in the detailed description which follows, in reference to the noted plurality of drawings by way of non-limiting examples of embodiments of the present invention, in which like reference numerals represent similar parts throughout the several views of the drawings, and wherein.

DETAILED DESCRIPTION OF THE PRESENT INVENTION

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description taken with the drawings making apparent to those skilled in the art how the several forms of the present invention may be embodied in practice.

Figure 1:
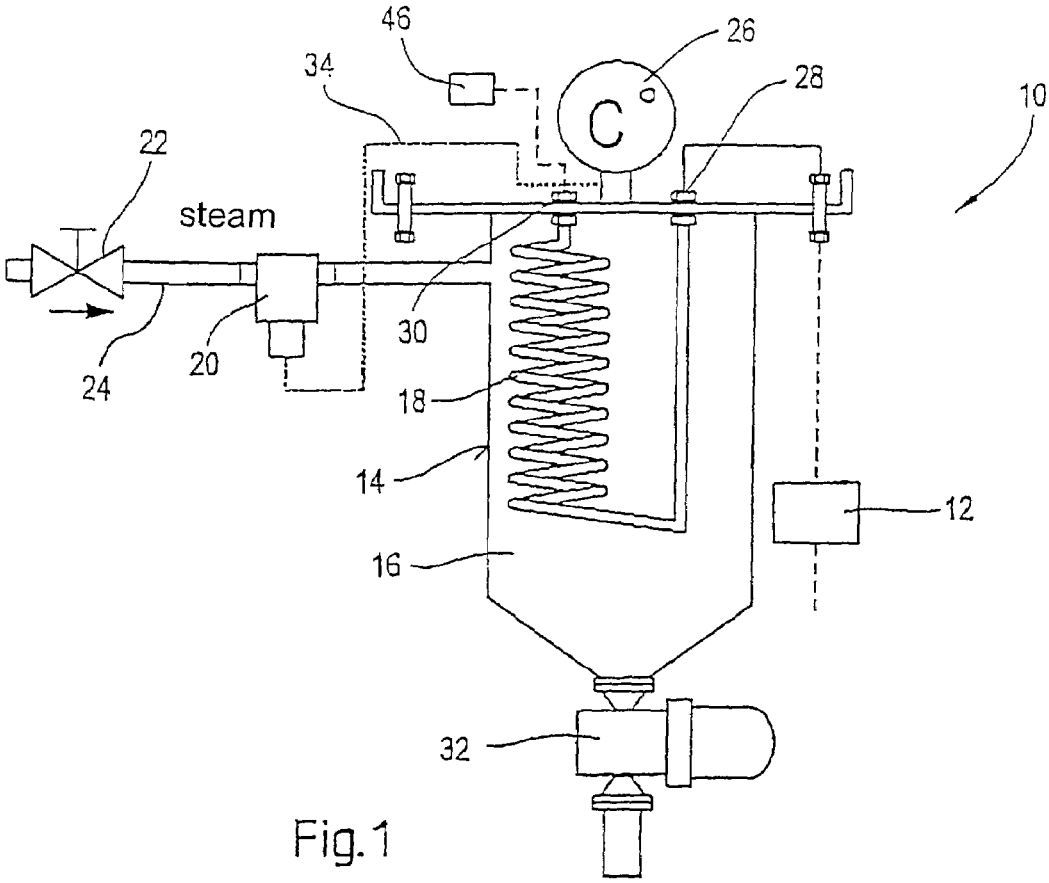
FIG. 1 shows a diagrammatic partial representation of a device comprising a high-pressure heat exchanger for cleaning a circulating belt of a paper machine.
Figure 2:
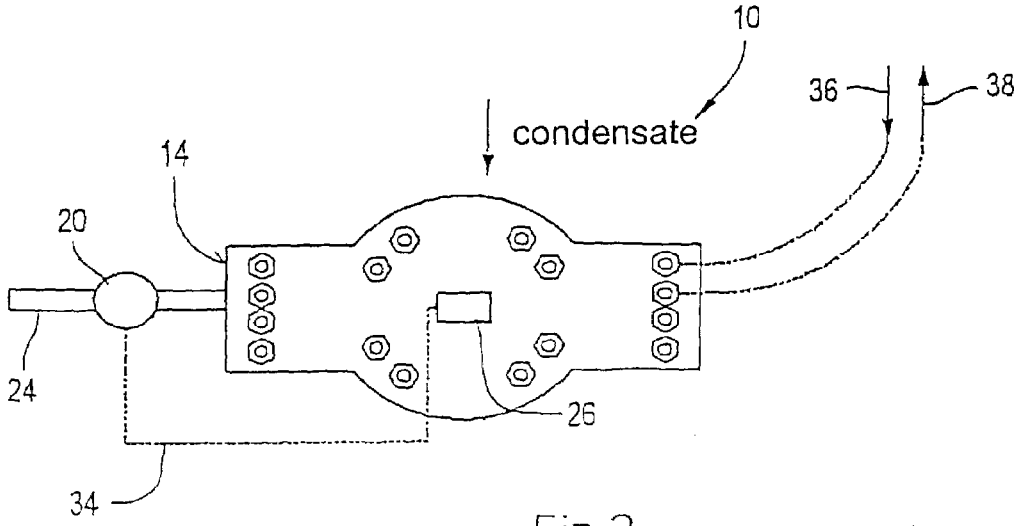
FIG. 2 shows a diagrammatic plan view of the high-pressure heat exchanger shown in FIG. 1.

FIGS. 1 and 2, purely by way of example, show a diagrammatic partial representation of an embodiment of the invention. The device 10 for cleaning a circulating belt is used in a paper machine. The belt can be of the kind that is, in particular, a wire or felt belt.

The device 10 includes at least one nozzle 46 for producing a respective fluid jet. The nozzle 46 is coupled to a traversing unit 47 (see FIG. 3) which can be acted on by pressurized water having a temperature of between approximately 90° C. to approximately 160° C. However, temperatures in the range of between approximately 100° C. to approximately 140° C. are preferred.

The respective nozzle can thereby be acted on by highly pressurized water, whereby the pressure is preferably in a range of between approximately 100 bar to approximately 500 bar.

In particular, a high-pressure water pump 12 can be provided to produce the high pressure.

The water is heated on the high-pressure side, i.e., behind the high-pressure pump 12, by way of a high-pressure heat exchanger 14 to a temperature in the range previously specified.

The high-pressure heat exchanger 14 includes a container 16 in which a heat carrier such as steam is fed. The source of steam can be that which has been removed from the steam cycle of the paper machine. Arranged in the container 16 is at least one high-pressure tube 18. As can be seen in FIG. 1, the tube 18 is spirally formed or wound. This design allows the highly pressurized water to be heated in the tube 18.

The invention contemplates that the pressure in the container 16 can be higher than, approximately the same as, or lower than the ambient pressure.

The container 16 is preferably made of high-grade steel such as stainless steel. However, other materials may also be utilized.

The temperature in the container 16 can be controlled via a valve which affects the steam intake. The valve may be a temperature interlock 20. However, the invention also contemplates that other ways can be employed to control and/or regulate the temperature inside the container 16. Another valve 22 is located upstream of the valve 20. This valve 22 can be a manual valve. In the embodiment shown in FIG. 1, the two valves 20, 22 are assigned to a steam supply pipe 24 which supplies steam to the container 16.

The temperature interlock 20 communicates with or is connected to a temperature control system 26 which also receives an actual temperature value inside the container 16. In this way, the control system 26 is able to control the temperature interlock 20 in line with maintaining a nominal preset or desired temperature value. A connection 34 is provided between the temperature interlock 20 and the temperature control system 26. However, the invention also contemplates other ways of facilitating communication between the control system 26 and the valve 20.

An inlet 28 is arranged at an upper part of the container 16. The inlet 28 of the high-pressure heat exchanger 14 is connected to the high-pressure water pump 12 and receives the high-pressure water therefrom. An outlet 30 is also arranged on the container. The outlet 30 communicates with and/or is otherwise connected to the nozzle 46. The outlet 30 supplies the heated water to the nozzle 46, so that the nozzle can use the heated water to clean the belt. In principle, several such nozzles 46 can also be provided, with each being connected to the heat exchanger 14. Alternatively, a number of heat exchangers 14 can be utilized and each nozzle 46 can be connected to a respective heat exchanger 14.

A steam trap 32 can be provided at the base of the high-pressure heat exchanger 14. This steam trap may additionally serve as a ventilator.

FIG. 2 shows the high-pressure heat exchanger 14 represented in FIG. 1 in a diagrammatic plan view. The connection 34 between the temperature interlock 20 and the temperature control system 26 is again indicated. Moreover, in FIG. 2 an additional inlet 36 is provided which allows another feed line, i.e., high-pressure cold water or the like to be connected to the container 16. An additional outlet 38 is also provided. This outlet 38 allows for the discharge of high-pressure hot water. The temperature control system 26 is also indicated once again in this representation.

Figure 3:
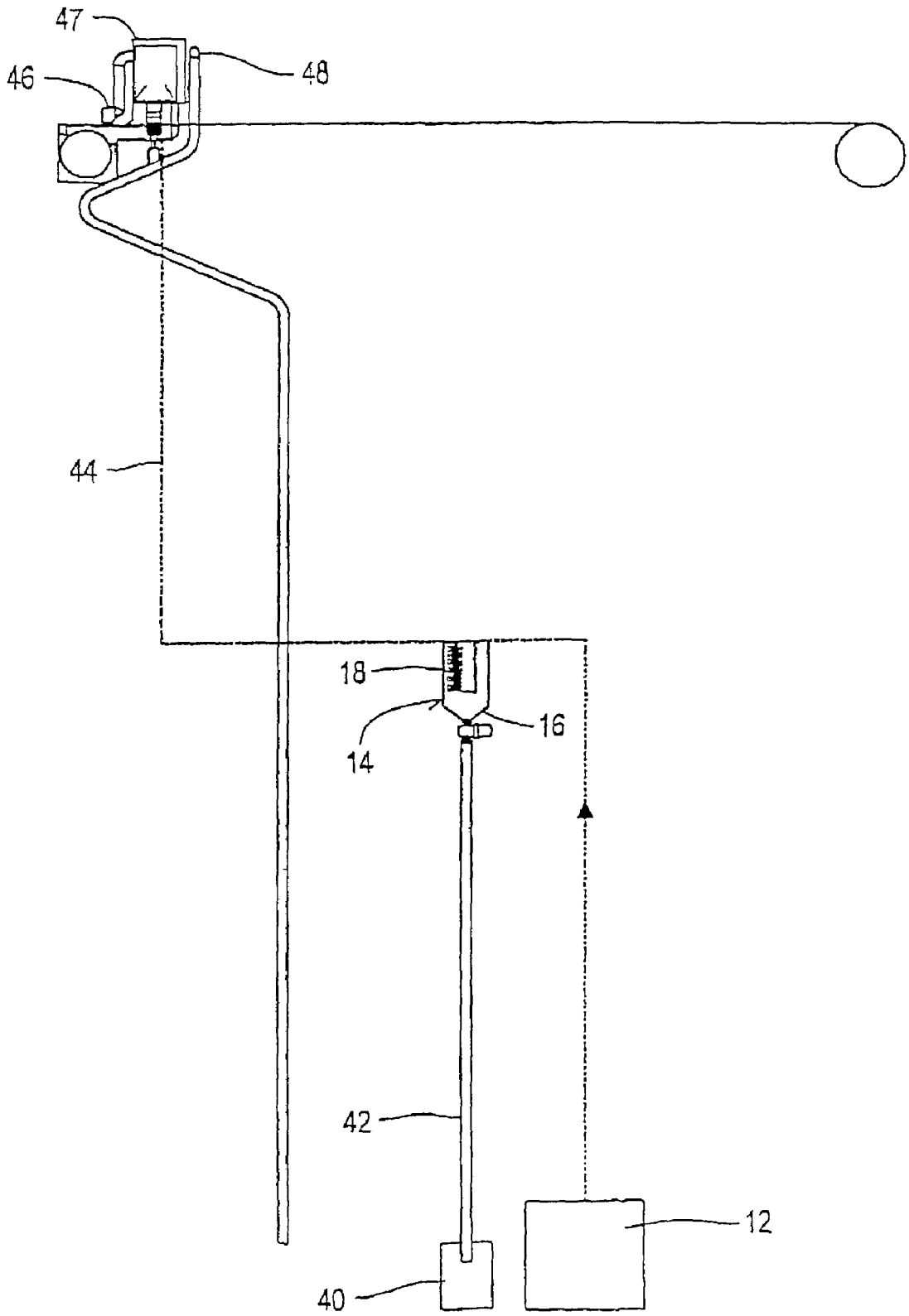
FIG. 3 shows a diagrammatic overall view of another embodiment of the cleaning device. The device uses a down pipe for producing a reduced pressure.

FIG. 3 shows in diagrammatic representation an overall view of another embodiment of the cleaning device 10, in which a down pipe 42, which is immersed in a condensation tank 40, is coupled to the container 16 of the high-pressure heat exchanger 14, the purpose of which is to produce a pressure in the container 16 that is lower than the ambient pressure. In this way, the heat of condensation of the steam can be used even at temperatures below 100° C. For example, a reduced pressure of approximately 0.5 bar is necessary for a condensation point of, e.g., approximately 80° C. and this can be achieved in a simple way, e.g., by using a down pipe of a height of approximately 5 m.

The high-pressure pump 12 is connected to the inlet 28 (see also FIG. 1) of the high-pressure heat exchanger 14. A high-pressure line 44, which conducts the heated fluid, is connected to the outlet 30 (see also FIG. 1) of the high-pressure heat exchanger 14. Another end of the high-pressure line 44 is connected to the nozzle or nozzles 46 acting on the relevant belt.

Moreover, as can be seen from FIG. 3, a bypass 48 conduit can be provided for the exhaust air.

An improved cleaning is obtained with the cleaning devices 10 described herein. The heated water evaporates more quickly, since a part of the necessary energy is already available. When the cleaning device is in a drying section, there is also the advantage that the wire to be cleaned is not caused to cool down. Moreover, as a result of this design, no condensation occurs on the suction system. The dirt which is on the belt also dissolves or is otherwise removed more quickly in the heated liquid. It is also advantageous that the heated water has a lower viscosity.

It is noted that the foregoing examples have been provided merely for the purpose of explanation and are in no way to be construed as limiting of the present invention. While the present invention has been described with reference to an exemplary embodiment, it is understood that the words which have been used herein are words of description and illustration, rather than words of limitation. Changes may be made, within the purview of the appended claims, as presently stated and as amended, without departing from the scope and spirit of the present invention in its aspects. Although the present invention has been described herein with reference to particular means, materials and embodiments, the present invention is not intended to be limited to the particulars disclosed herein; rather, the present invention extends to all functionally equivalent structures, methods and uses, such as are within the scope of the appended claims.

What is claimed:

1. A process for cleaning a circulating belt using a cleaning device having at least one nozzle, the process comprising:

heating a pressurized fluid using steam;

the steam being removed from a steam cycle of a paper machine;

feeding a pressurized fluid to the at least one nozzle; and subjecting the circulating belt to the pressurized fluid via the at least one nozzle, wherein the pressurized fluid comprises a temperature in a range of between approximately 90° C. and approximately 160° C.

2. The process of claim 1, further comprising feeding the steam to a container which houses at least one high-pressure tube and heating the pressurized fluid inside the at least one high-pressure tube.

3. The process of claim 2, wherein the at least one high-pressure tube is one of spirally formed and spirally wound.

4. The process of claim 2, further comprising creating a pressure in the container which is approximately equal to or greater than ambient pressure.

5. The process of claim 2, further comprising creating a pressure in the container which is approximately equal to or less than ambient pressure.

6. The process of claim 2, further comprising controlling a pressure in the container using a down pipe immersed in a condensation tank.

7. The process of claim 2, further comprising maintaining a reduced pressure in the container using a down pipe immersed in a condensation tank.

8. A process for cleaning a circulating belt using a cleaning device having at least one nozzle, the process comprising:

feeding a pressurized fluid to the at least one nozzle; and subjecting the circulating belt to the pressurized fluid via the at least one nozzle, the pressurized fluid having a temperature in a range of between approximately 90° C. and approximately 160° C.;

controlling an amount of pressurized fluid which is applied to the circulating belt; and regulating both the amount of pressurized fluid and the temperature of the pressurized fluid such that at least approximately 50% of the pressurized fluid evaporates after the subjecting.

9. The process of claim 8, wherein more than approximately 60% of the pressurized fluid evaporates after the subjecting.

10. The process of claim 9, wherein at least approximately 70% of the pressurized fluid evaporates after the subjecting.

* * * * *